United States Patent [19]

Ekker

[11] Patent Number: 4,708,099

[45] Date of Patent: Nov. 24, 1987

[54] CRANKLESS RECIPROCATING INTERNAL COMBUSTION ENGINE

[76] Inventor: Frank A. Ekker, 168 S. E. R. R. Ave., Ponchatoula, La. 70454

[21] Appl. No.: 808,102

[22] Filed: Dec. 12, 1985

[51] Int. Cl.[4] ..... F02B 75/16; F02B 75/08

[52] U.S. Cl. ..... 123/54 A; 123/61 R; 123/417; 123/668

[58] Field of Search ..... 123/54, 61 R, 417, 559 R, 123/657, 668, 669, 193 R, 193 P

[56] References Cited

U.S. PATENT DOCUMENTS

| | | | |
|---|---|---|---|
| 1,580,249 | 4/1926 | Hornor | 123/54 B |
| 1,955,620 | 4/1934 | Buchi | 123/61 R |
| 3,868,932 | 3/1975 | Toth | 123/197 R |
| 3,959,974 | 1/1976 | Thomas | 123/1 R |
| 4,442,812 | 4/1984 | Mizuno et al. | 123/417 |
| 4,445,336 | 5/1981 | Inoue | 123/559 R |
| 4,598,675 | 7/1986 | Long | 123/90.51 |

*Primary Examiner*—Craig R. Feinberg

[57] ABSTRACT

Present reciprocating engines have limitations on their thermal efficiency and horsepower to weight performance imposed by the crankshaft. Elimination of the crankshaft, use of a full time turbocharger and ceramic lining of cylinder walls, cylinder and piston heads and exhaust conduits permit the construction of an engine which has a thermal efficiency and horsepower to weight performance exceeding that of present engines. Use of ceramic linings is not essential to the operation of the engine. Thermal efficiency without ceramic linings is still better than that of crankshaft engines. Power produced by said crankless engine is oscillatory however this is readily rectified into rotary power.

2 Claims, 4 Drawing Figures

CRANKLESS RECIPROCATING INTERNAL COMBUSTION ENGINE

Figure 1:
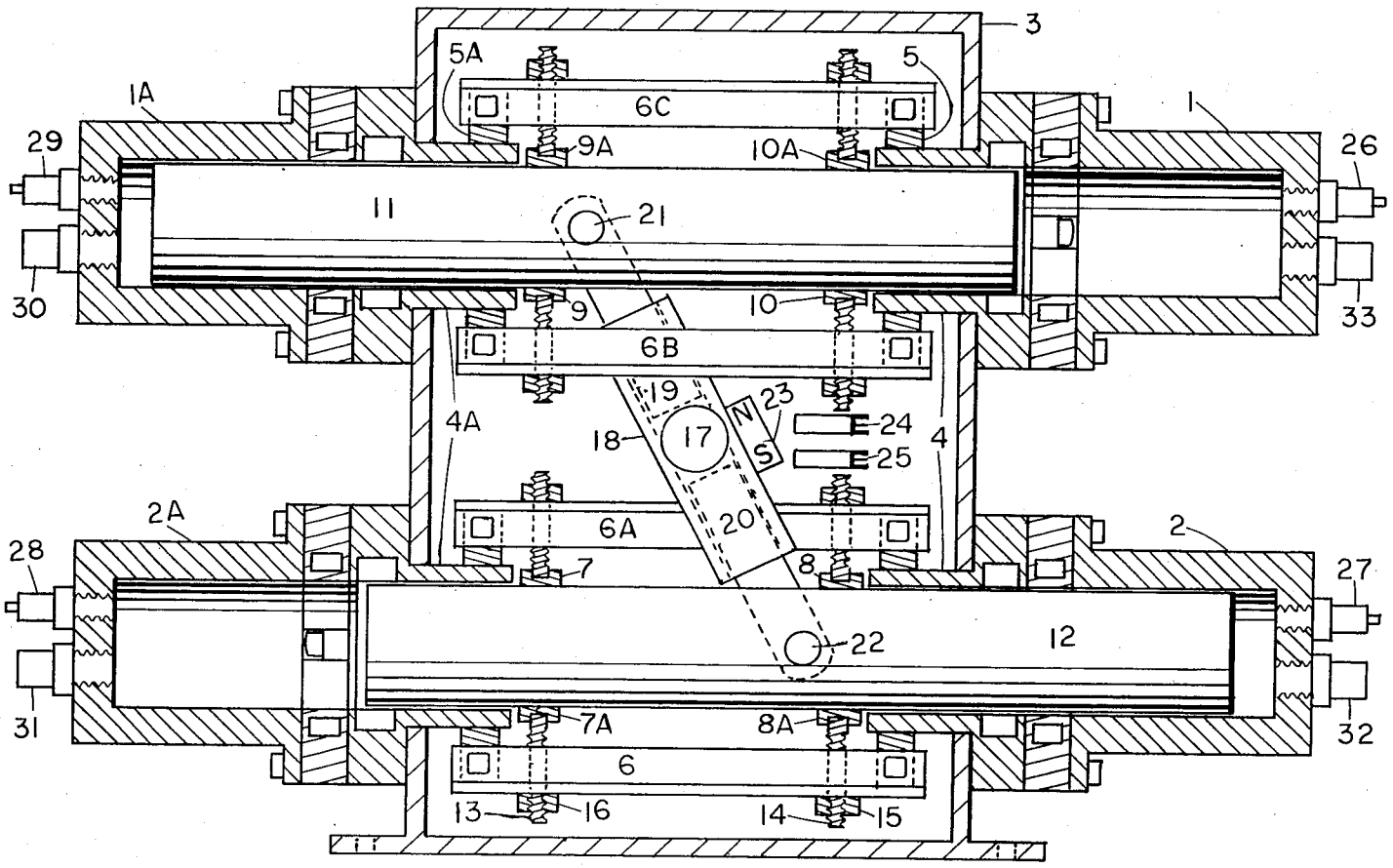

This invention relates to reciprocating internal combustion engines and specifically to one that does useful work without utilizing a crankshaft.

Heretofore the inevitable use of a crankshaft in reciprocating internal combustion engines has placed limitations on the thermal efficiency and horsepower to weight performance of the engines.

Use of a crankshaft limits thermal efficiency by limiting the amount of turbocharger boost that can be applied to an engine thereby not utilizing all the heat energy available in the engine exhaust gases. A crankshaft further limits thermal efficiency by limiting the maximum compression ratio usable in the engine and has a less than desirable efficiency in rectifying the reciprocal movements of the pistons into rotary power output.

The manner in which a crankshaft rectifies reciprocating movement of the pistons and because of the relative positions the pistons and crankshaft occupy in order for the combination to work imposes tremendous stress on the crankshaft and its supporting bearings and engine crankcase at each end of the piston stroke. As a consequence the crankshaft, bearings and crankcase must be massive structures. The requirement for strength translates into heavy structures and limits the horsepower per pound of engine weight the engine can produce.

The invention has two primary objectives. First, to produce work from an internal combustion engine with a thermal efficiency higher than from presently known reciprocating internal combustion engines. Second, to produce more horsepower per pound of engine than is possible with presently known reciprocating internal combustion engines.

To meet the stated objectives the following criteria control the engine design:

A. Eliminate the usual crankshaft,
B. Use pistons and cylinders as this combination is still the best way to extract work from combustion gases of an internal combustion engine,
C. Use compression ratios higher than 20:1, the approximate maximum presently used,
D. Use the Diesel combustion cycle to attain high thermal efficiency,
E. Use the two stroke engine cycle to attain high horsepower to weight performance,
F. Eliminate piston rings to reduce internal friction,
G. Eliminate lubrication requirement for piston and cylinder walls to permit high combustion temperature,
H. Reduce heat loss through cylinder walls and heads, piston heads and exhaust conduits by lining with ceramic or by raising cylinder wall and piston operating temperatures,
I. Route all exhaust gases through turbocharger turbine to compress combustion air entering cylinders as this extracts all usable energy from combustion gases exiting the cylinders and raises engine compression ratio in doing so,
J. Use compression ignition above compression ratio of 18:1 and combination spark and compression ignition for compression ratios below 18:1 as this increases operating range of engine, K. Use electronically controlled fuel injection to permit very accurate timing of fuel injection,
L. Use piston reciprocating rates above 4000 strokes per minute to permit high horsepower to weight engine performance,
M. Use reed valves to control combustion air entering cylinders to minimize breathing restriction,
N. Remove all restrictions to exhaust gas flow from cylinders to turbocharger to minimize engine breathing restriction.

Further objects and advantages of the invention will become apparent from a consideration of the drawings and ensuing description thereof.

Figure 2:
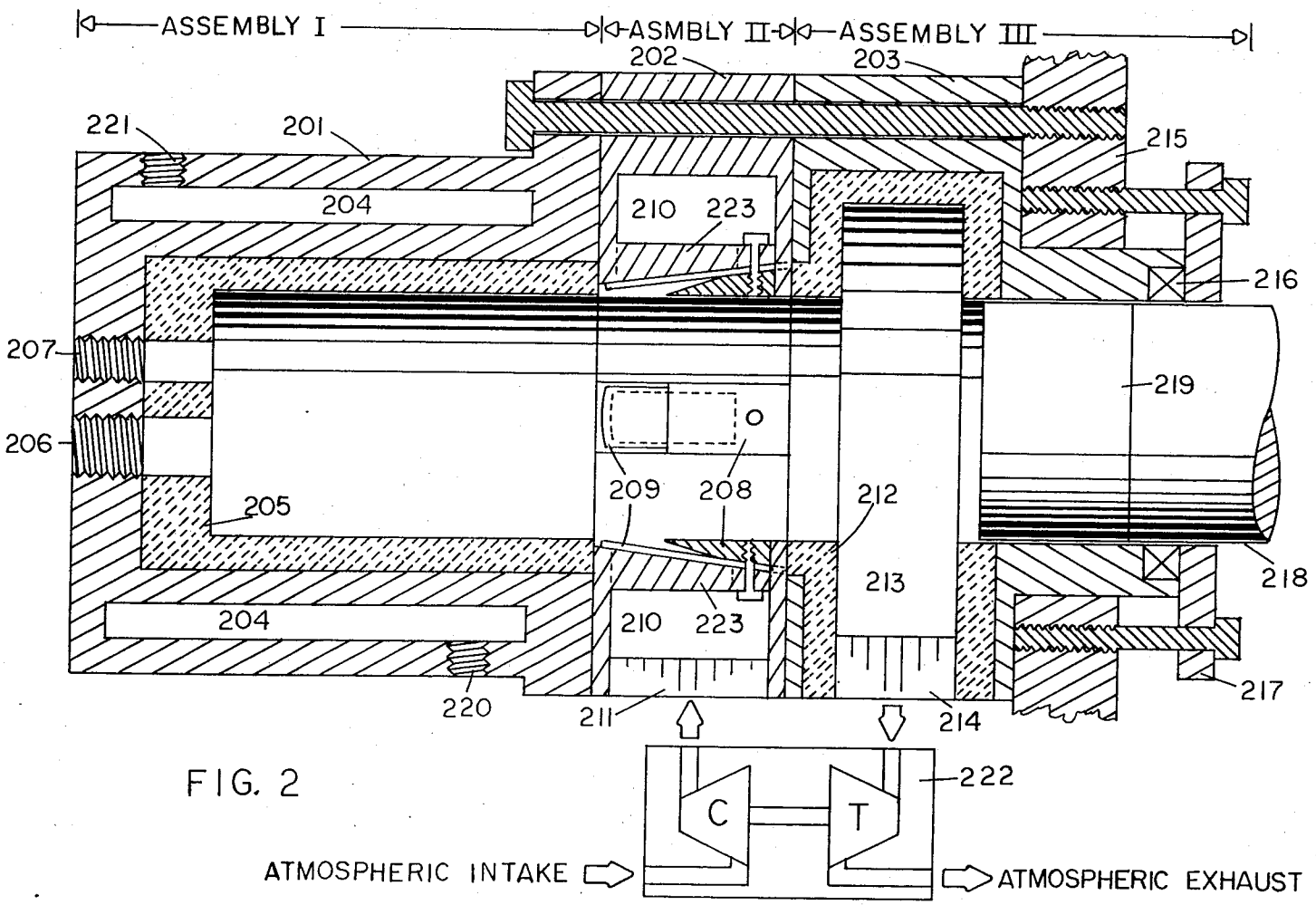
Figure 3:
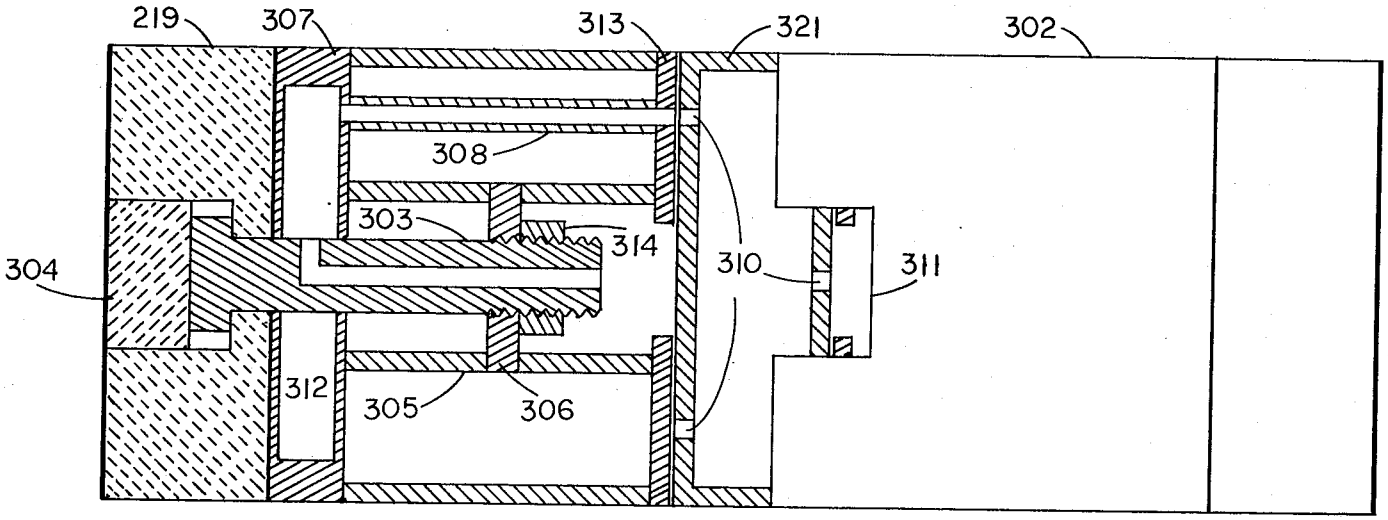
Figure 4:
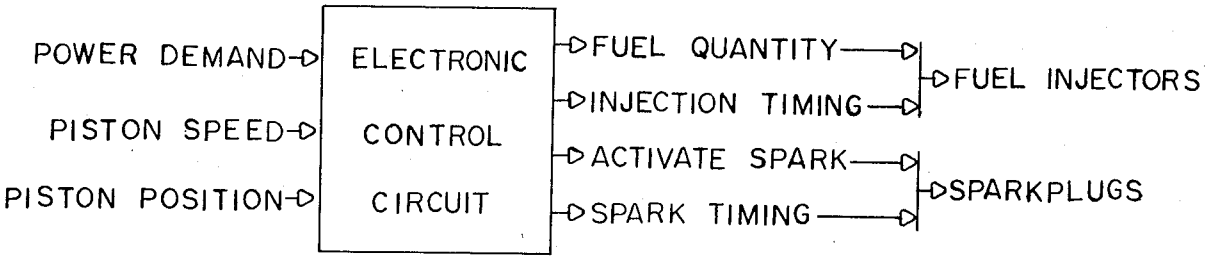

FIG. 1 is a longitudinal cross section of an engine according to this invention, FIG. 2 is a center line cross section of a cylinder showing more constructional detail, FIG. 3 is a plan view, part in section, of a piston according to this invention, and FIG. 4 is a black box representation of the electronic circuit required to control this invention.

The engine as shown on the drawing comprises two pairs of opposed cylinders 1, 1*a* and 2, 2*a* supported by housing 3. The skirts of the cylinders 4, 4*a* extend through the housing walls. Means are provided to adjustably attach at least two preferably three or four ears 5, 5*a* to each skirt. For drawing clarity only two ears per cylinder are shown. The ears on cylinders 1 and 1*a* are placed in alignment with each other along the cylinder pair axial center line and the ones on cylinders 2 and 2*a* are also placed in alignment such that sturdy support means, in this example "T" bars, can be bolted to the ears. When properly bolted and aligned, the axial center lines of "T" bars 6, 6*a* are parallel to the axial center line of cylinder pair 2, 2*a* and "T" bars 6*b*, 6*c* are parallel with the axial center line of cylinder pair 1, 1*a* and none of the "T" bars interfere with moving parts of the engine. The "T" bars support means to firmly hold bearings 7,7*a*,8,8*a*,9,9*a*,10,10*a*. The support means for the bearings are also adjustable such that the distance of the bearings from the axial center line of the cylinders can be varied. In this example the "T" bars have been drilled and tapped through the web of the bar and threaded rods 13, 14 and lock nuts 16, 15 assure the adjustments do not change on their own. Two "T" bars are shown in the drawing but three or four are preferred per cylinder pair. Two can be used, but then design of the bearings becomes more complex. The purpose of the bearings is to support and guide the pistons so that no physical contact of the pistons occurs with the cylinders under normal engine operation. The single, two headed piston 11, operates in cylinder pair 1, 1*a* and the single, two headed piston 12, operates in cylinder pair 2, 2*a*. The said bearings prevent any physical contact of the pistons with the cylinders. The bearings are adjusted such that the pistons are centered in the cylinders.

The piston support and guide devices can be pad type sliding bearings as presented in this example of the invention, however they can also be made of rolling elements or even segmented circular sliding elements. The support elements for the guide devices require rigidity as their main function hence there are many ways other than presented to accomplish this, even to the point of modifying the housing 3, FIG. 1 or the cylinder skirts 4, 4*a*, FIG. 1. Therefore the example presented is not intended to limit the scope of the invention.

The pistons are synchronized and power is extracted from them through the linkages comprised of components 17,18,19,20. The power output shaft 17 extends through the back and front walls of the housing and is supported by bearings in the back and front walls. A sturdy receptacles 18 accepts the piston connecting rods 19, 20. Receptacle 18 is firmly attached to power output shaft 17 as the full power of the engine must be transferred from the pistons to the power output shaft 17 through the piston pins 21, 22 and the piston connecting rods 19, 20 and receptacle 18. Connecting rods 19, 20 slide into and out of receptacle 18 in normal engine operation to adjust for the change in distance between the center lines of piston pins 21, 22 and the center line of power output shaft 17 as the pistons operate between their associated cylinder pairs.

Sprockets and chain, drums and cable, drums and flexible bands and gears and gear racks can all be used to extract power from the pistons. Therefore the example of the linkage presented is not intended to limit the scope of the invention.

A magnet 23 is firmly attached to receptacle 18 and as said receptacle rocks back and forth in operation, sensors 24, 25 sense the magnet position and thereby identify the piston positions for the electronic control circuit FIG. 4 so fuel injection and spark ignition can be timed. Sensors 24, 25 are Hall effect devices, but this function can be performed by other means as well.

Sensing piston position can be accomplished by use of optical means, electromagnetic means and by use of magnets combined with wire wound coils or electromagnetic circuits. Thus the example of Hall effect devices combined with a magnet presented in this illustration of the invention is not intended to limit the scope of the invention.

Components 30,31,32,33 are electronically controlled fuel injectors and components 26,27,28,29 are sparkplugs.

FIG. 2 illustrates the constructional details of the cylinders. They are made up of three separate assemblies. Assembly I is the combustion chamber, Assembly II is the combustion air inlet reed valve assembly and Assembly III is the exhaust port assembly. Assembly I comprises the metal combustion chamber housing 201 which has cooling medium threaded ports 220,221 annular coolant passage 204, sparkplug threaded opening 207, fuel injector threaded opening 206 and ceramic lining 205. Assembly II comprises the metal housing 202, annular combustion air inlet passage 210, combustion air inlet supply port 211, cylinder combustion air inlet reed valves 209, reed valve seats and support structures 223 and reed valve flexing limiters 208. Assembly III comprises the metal housing 203, completely unobstructed annular exhaust port passage 213, exhaust gas outlet 214, ceramic lining 212, piston oil wiper packing 216 and piston oil wiper packing follower 217. Component 215 is the housing wall, component 218 is the metal piston body and component 219 is the ceramic head of the piston. The piston is shown in this illustration to show how it relates to the cylinder.

It is obvious that the cylinder does not have to be made in three assemblies, but can be one assembly, and that poppet valves or valves of other configurations can be used instead of reed valves to control the flow of fresh combustion air into the cylinder and keep exhaust gases from entering the fresh combustion air inlet passage 210, FIG. 2. It is also obvious that ceramic linings of the combustion chamber Assembly I, exhaust port passage 213 and outlet 214, all FIG. 2, are not necessary requirements for the invention to work. Therefore the detailed constructional illustration is intended to aid in presenting a clear conveyance of the invention and not to limit its scope to the constructional details presented.

FIG. 3 illustrates the constructional details of the double headed piston in the example of the invention. The piston is comprised of a metal body capped with ceramic heads on each end. The metal body 218 is constructed of two thin walled metal tubes concentrically placed, the outer tube 302 and the inner tube 305. The tubes are held in position by circular metal head 307 containing oil coolant cavity 312. Centrally located and at right angles to the piston axial center line is located the piston pin 321 and supporting bearing 313. Oil holes 310 in the piston pin allow for lubricating oil flow to the piston pin and connecting rod bearings and for a cooling flow of oil to the head 307 by tubing connection 308. The ceramic head 219 is held to metal head 307 by a bolt 303 which passes through the ceramic head 219, metal head 7 and a firmly placed plate 306 inside the center tube 305 of the metal piston body. Lock nut 14 secures the bolt and consequently the ceramic head. A ceramic plug 304 is permanently inserted over the bolt head to protect it from high temperature. Bolt 303 is also drilled to allow passage of cooling oil flow from the metal head cooling cavity 312 back to the connecting rod opening 311 in the piston body and from there into the crankcase.

The use of an oil flow to cool piston heads is prior art and is a necessity in this invention. However the use of a ceramic piston head is optional and illustrating it in this example of the invention is not intended to limit the scope of the invention.

FIG. 4 is a black box representation of the electronic control circuit. The horsepower demand on the engine controls the quantity of fuel injected by the fuel injectors and piston position and speed, as sensed by sensors 24,25, FIG. 1, determine timing of fuel injection as well as spark ignition. Spark ignition is activated only below compression ratio of 18:1 and this is indirectly expressed as engine speed and is different for each engine design. Therefore spark ignition is activated at a certain fixed engine speed for each engine and is not dependent upon operating conditions.

Starting of the engine is accomplished by supplying externally compressed combustion air to the cylinders and using an external means to rock the power output shaft 17, FIG. 1, back and forth with the electronic control circuit causing fuel to be injected and providing spark ignition.

After starting, pistons 11,12, FIG. 1 fly back and forth in their associated cylinder pairs **1,1*a* and 2,2*a*, FIG. 1 respectively. The pistons are guided and supported by bearings 10, 10*a*,9,9*a*,8,8*a*,7,7*a*, FIG. 1 and control the piston motion so no contact is made between the pistons and cylinders except for the piston oil wiper packing 216, FIG. 2. Hot exhaust gases leave the cylinders through the exhaust port passage 213, FIG. 2 and travel through the exhaust gas outlet 214, FIG. 2 to an ordinary turbocharger turbine 222 and from there to the atmosphere. The compressor side of the ordinary turbocharger 222 compresses fresh combustion air for the cylinders and this combustion air flows into the combustion air inlet support port 211, FIG. 2, into the annular combustion air inlet passage 210, FIG. 2 and through the combustion air inlet reed valves 209, FIG. 2 into the cylinder when the piston uncovers the exhaust port passage 213, FIG. 2 and the cylinder pressure decays below the air pressure in the combustion air inlet passage 210, FIG. 2. This process scavenges the exhaust gases from the cylinder and as the piston begins the return stroke, the exhaust port passage 213, FIG. 2 is covered by the piston and fresh combustion air continues to enter the cylinder until internal cylinder pressure exceeds combustion air inlet passage 210, FIG. 2 pressure or until the piston covers the inlet reed valves 209, FIG. 2 on its way into the combustion chamber Assembly I, FIG. 2. Combustion chamber pressure continues to increase until the kinetic energy in the moving piston assembly 11,12, FIG. 1 and associated power output linkages 17,18,19,20, FIG. 1 is converted to potential energy in the compressed combustion air. At this point the piston assembly stops and this is sensed by sensors 24,25, FIG. 1. The slowing and stopping of the piston assembly is noted by the electronic control circuit and it triggers the fuel injectors at the appropriate point in the stopping cycle to maximize combustion chamber pressure build-up brought on by the resultant combustion of the injected fuel. The piston assembly and associated linkages reaccelerate to engine speed and the piston proceeds out of the combustion chamber toward the exhaust port passage 213, FIG. 2 where it exhausts the combustion gases and then begins the cycle over again. Power flows from the reciprocating pistons 11,12 through piston pins 21,22, piston connecting rods 19, 20, piston connecting rod receptacle 18 and into power output shaft 17, all FIG. 1**.

The power produced by the invention is oscillatory and not rotary. However if the oscillatory power cannot be used directly several means are obvious and available to rectify the oscillatory power at higher efficiency than with a crankshaft into rotary power.

In the example of the invention two pistons operate in four cylinders to produce two power pulses per engine stroke. It is obvious that other piston and cylinder arrangements are possible therefore the example of the invention is not intended to limit the scope of the invention. Examples of such arrangements are eight and twelve cylinder versions.

What I claim is:

1. A crankless internal combustion engine comprising:

a. at least one ringless metal double headed piston having heads of which are lined with a heat insulating material, b. a pair of coaxial hollow cylinders per ringless piston which are held in alignment by a housing means so that the piston moves within the cylinder without physically contacting walls of the cylinder thus eliminating lubrication, c. piston support and guide bearings which are suitably attached near a bottom of each said cylinder of said pair external to the cylinder bore and serve as sole means to hold the piston in alignment with the cylinder bore so no physical contact occurs between the piston and the cylinder during operation, d. said housing means supporting and holding said coaxial cylinders and said piston support and guide bearings within suitable alignment to prevent unintended contact between the piston and the cylinder walls during operation, e. said coaxial cylinders equipped with fuel injectors, sparkplugs and inlet air valves in the walls of said cylinders, f. a power output shaft with its axial center line at right angles to the axial center line of the coaxial cylinder pair and suitably supported by the housing with means provided to reliably interconnect the double headed piston and the power output shaft, g. an electronic control circuit which monitors engine speed and load and commands the fuel injectors to make at least one fuel injection during a compression and expansion stroke and activates sparkplug firing when engine speed is too slow to maintain a compression ratio above 18:1, h. a high efficiency turbocharger attached such that maximum turbocharging of the engine results at all engine power levels and speeds.

2. An internal combustion engine cylinder according to claim 1, being constructed such that a combustion air inlet section to the cylinder is located between an exhaust port section and a remaining combustion chamber and that the combustion chamber is free of assembly split lines.

* * * * *